US005261441A

United States Patent [19]

Anderson

[11] Patent Number: 5,261,441

[45] Date of Patent: Nov. 16, 1993

[54] YARD HYDRANT

[75] Inventor: Stephen J. Anderson, Storm Lake, Iowa

[73] Assignee: Merrill Manufacturing Company, Inc., Storm Lake, Iowa

[21] Appl. No.: 58,869

[22] Filed: May 10, 1993

[51] Int. Cl.[5] ..... E03B 9/04; E03B 9/14

[52] U.S. Cl. ..... 137/281; 137/287; 137/301

[58] Field of Search ..... 137/281, 286, 287, 291, 137/301, 299, 302

[56] References Cited

U.S. PATENT DOCUMENTS

| | | | |
|---|---|---|---|
| 3,082 | 5/1843 | Davies | 137/281 |
| 16,448 | 1/1857 | Morgan | 137/281 |
| 100,389 | 3/1870 | Fort | 137/281 |
| 109,587 | 11/1870 | Clampitt | 137/281 |
| 130,166 | 8/1872 | Walsh | 137/281 |
| 163,759 | 5/1875 | Fisher et al. | 137/281 |
| 3,770,003 | 11/1973 | Uroshevich | 137/281 |
| 3,926,206 | 12/1975 | Anderson | 137/281 |
| 3,926,207 | 12/1975 | Anderson | 137/281 |
| 4,653,522 | 3/1987 | Fillman et al. | 137/281 |

*Primary Examiner*—George L. Walton
*Attorney, Agent, or Firm*—Morton S. Adler

[57] ABSTRACT

A yard hydrant includes a discharge nozzle above ground level connected to other vertically reciprocal working parts in the ground below the frost line. A cylindrical water reservoir unit, disposed below the frost line around said working parts, includes a diaphragm assembly removably attached to such working parts for reciprocation therewith, and a deformable diaphragm on said assembly provides a water storage area. Residual water in the hydrant when it is turned off is collected in the storage area and returned to the hydrant for discharge through the nozzle when the hydrant is turned on. The working parts are removable from the diaphragm assembly for servicing and repairs.

17 Claims, 5 Drawing Sheets 64
10
60
16
62
58
76
66'
66
70
70'
46
74
74'
72
72'
68
14
12
12
18
32
42
30
42
26
34
93
94
92
56
52
46
50
54
140
88
140'
90
98
100
82
80
84
95
96
126
130
132
128
134
138
134
40
28
36
38
42
42
48
22
24

60
64
16
10
72'
72
62
58
6
76
6
66
70'
70
120
68
12
118
46
118
46
18
12
9
30
20
142
142'
88
92
44
7
82
102
106
7
140
86
140'
98
100
104
8
8
138
132
84
126
80
134
96
134
136
95
56
36
52
46
50
54
22
48
24

YARD HYDRANT

BACKGROUND OF THE INVENTION

This invention relates to improvements in yard hydrants.

The yard hydrant conventionally includes a discharge nozzle above ground level connected to a standpipe or riser that extends into the ground below the frost line to well known working parts connected to a source of water supply under pressure. When water flow is turned off, residual water within the hydrant is subject to freezing at freezing temperatures and to avoid such freezing, a common expedient has been to provide a drain hole below the frost line so the water will drain out into the surrounding ground. A disadvantage with such a drain hole is the fact that it is also a means for reentry of water into the hydrant which intermixes with other water passing therethrough so that under such conditions, there is the possibility of contamination of the hydrant water from impure seepage which, if it occurs, can result in deleterious effects upon the user and very likely be in violation of rules and regulations relating to water sanitation. Accordingly, in the hydrant art, structures have been developed which eliminate the drain hole and substitute some form of a storage reservoir whereby the residual water can be contained and subsequently discharged above ground level. It is with improvements in such a reservoir component that this invention is concerned.

With some of such structures, the reservoir is constructed within the riser pipe which must, of necessity, be of a large enough diameter to accommodate the reservoir components that exceeds the diameter of conventional standard size pipe sufficient for the hydrant water flow purposes, and in other forms, the reservoir is an entirely separate unit requiring additional separate flow connections to the riser pipe. With both arrangements, there are required components that add to rather than reduce the overall cost of the product, and thus, in an industry where there is a constant search for lower cost alternatives and where minor reductions in costs can become a formidable and valuable asset when mass production is involved as it is in this field, these present type of hydrant reservoir constructions have the disadvantage of not being cost effective for enhancing the marketability and sale of the finished product.

With the above observations in mind, it is one of the important objects of this invention to provide a yard hydrant with a separate sealed water reservoir built around a standard size standpipe or riser.

Another object herein is to provide a reservoir as characterized that is isolated from the water system pressure of the hydrant.

A further object is to provide a reservoir of the above class that includes a deformable diaphragm for enlarging a water storage area.

Still another object is to provide a yard hydrant reservoir into which water left in the hydrant flow line when the flow is shut off is transferred directly into the reservoir without danger of pollution.

A further object is to provide a yard hydrant as characterized in which substantially all of the stored water is expelled through the nozzle when the hydrant is turned on.

Another object is to provide a hydrant of the above class in which internal parts within the riser can be quickly and easily withdrawn for repairs or servicing.

Another object is to provide a hydrant as characterized that affords economies in manufacture for its intended purpose.

SUMMARY

A yard hydrant has a push down type of discharge nozzle head above ground level connected to a standpipe or riser that extends into the ground below the frost line to well known vertically reciprocal working parts connected to a source of water supply under pressure. A cylindrical water reservoir unit is disposed below the frost line around said working parts and includes a diaphragm assembly removably attached to such working parts for vertical reciprocation therewith. Within the diaphragm assembly is a deformable diaphragm forming an expandable water storage area in flow communication with the hydrant flow system. An air line from above ground level communicates with the storage area. When the water is shut off by raising the nozzle head, the diaphragm assembly moves upwardly with the working parts to enlarge the water storage area at which point certain ports in the hydrant come into communication with the storage area so that residual water in the hydrant flows into such area. As the diaphragm assembly is being raised and before flow communication is established with the hydrant, air can enter the storage area through the air channel to occupy the storage space created. When the flow is again started by pushing the nozzle head downwardly, water in the storage area flows through check valves therein to the hydrant for discharge at the nozzle. The riser is threadably attached to the diaphragm assembly so that the working parts can be removed for servicing and repairs. Means are provided to prevent rotation of the diaphragm assembly when the riser is being rotated for separation therefrom.

The foregoing objects and such further objects as may appear herein, or be hereinafter pointed, together with the advantages of this invention will be more fully discussed and developed in the more detailed description of the accompanying drawings.

DESCRIPTION OF THE PREFERRED EMBODIMENTS

Figure 1:
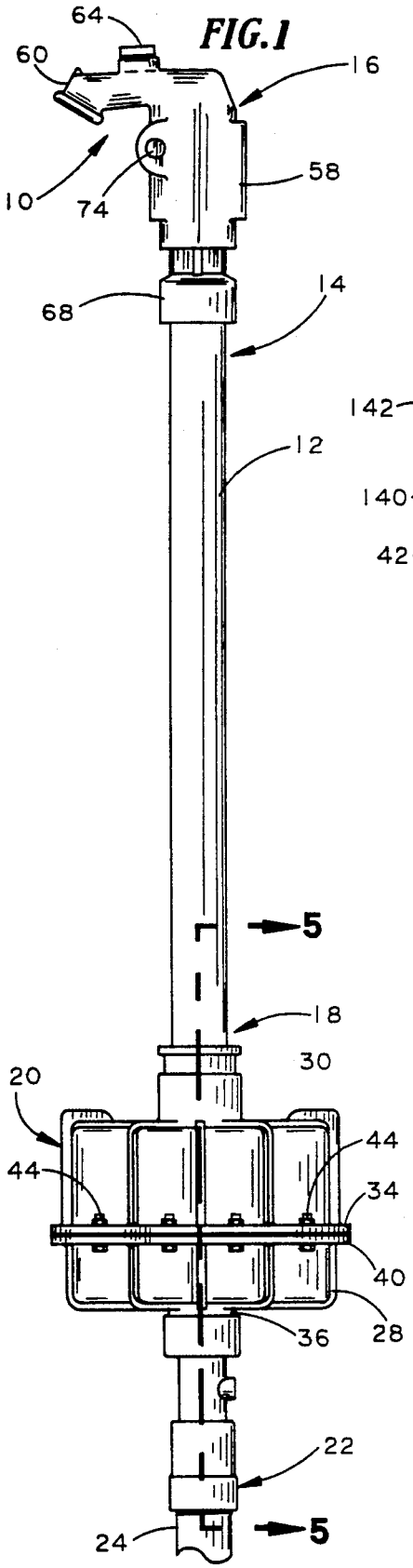
FIG. 1 is an elevational view of a yard hydrant constructed according to my invention.

Referring to the drawings, this new hydrant, designated by the numeral 10, includes, in brief, the general components (FIG.1) of an elongated outer casing 12 having its upper end 14 above ground level attached to a head section 16, and its lower end 18 extending into the ground below the frost line for axial attachment to a cylindrical water storage reservoir unit 20, which is one of the important features of this invention, and which in turn is axially attached to a valve body housing 22 adapted for connection to a source of water supply under pressure through pipe 24, all of which parts and other operating parts will now be described in more detail.

Figure 2:
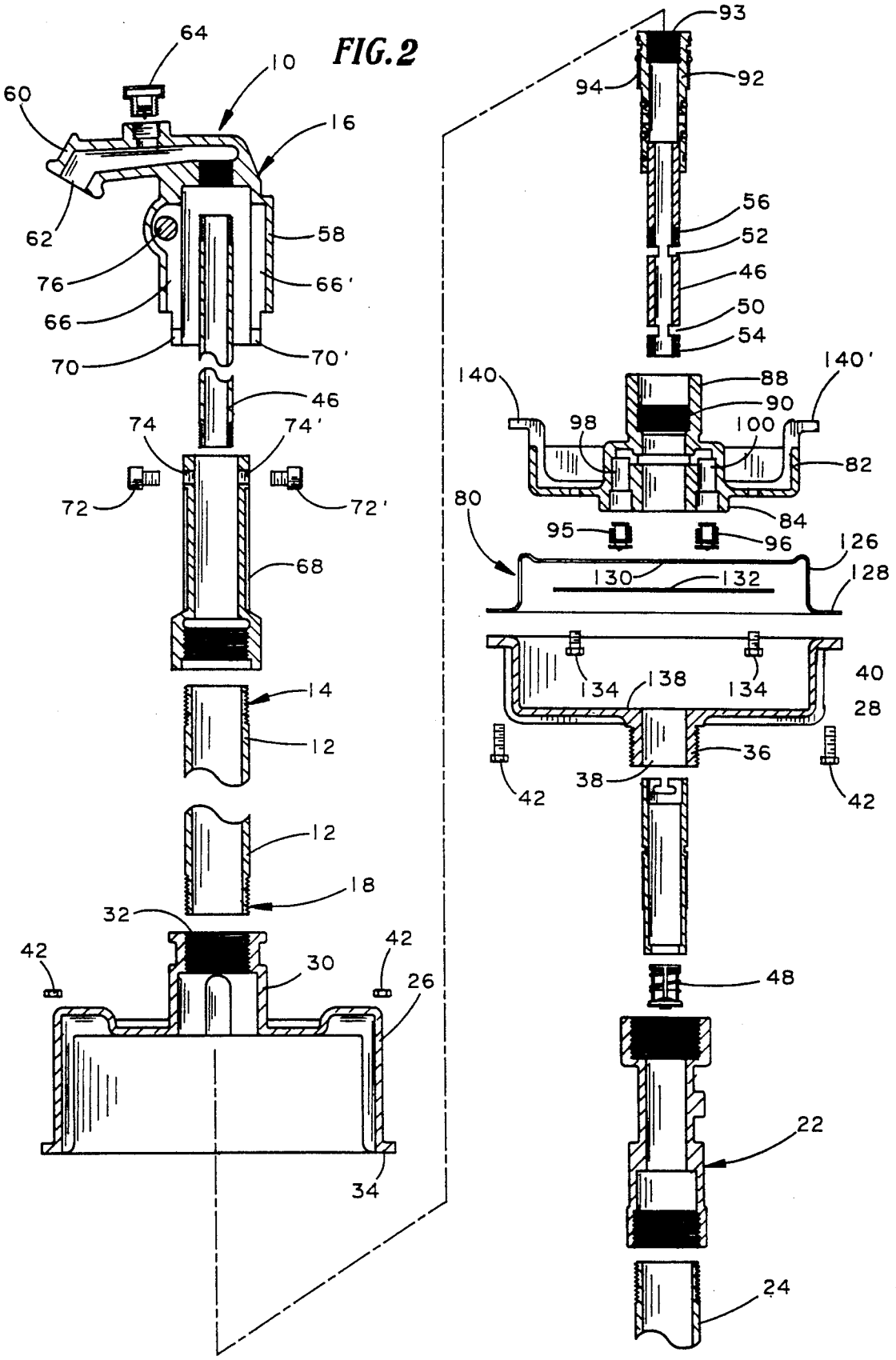
FIG. 2 is an exploded longitudinal sectional view of the device in FIG. 1 to show the several components thereof.
Figure 3:
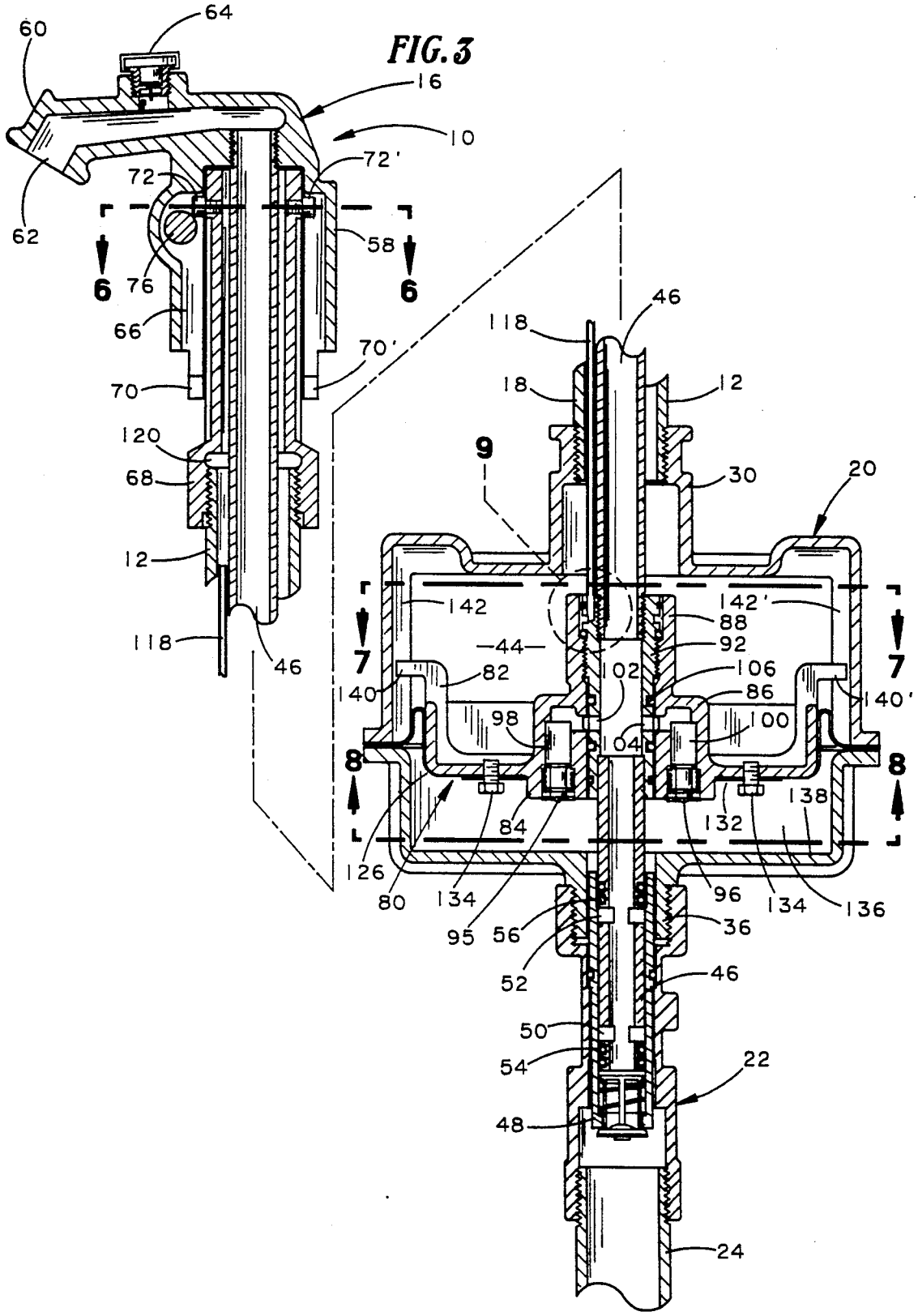
FIG. 3 is an enlarged longitudinal sectional view of the device in FIG. 1 shown in open or on position and showing the lowermost position of the diaphragm assembly defining the smallest dimension of the water storage area.
Figure 4:
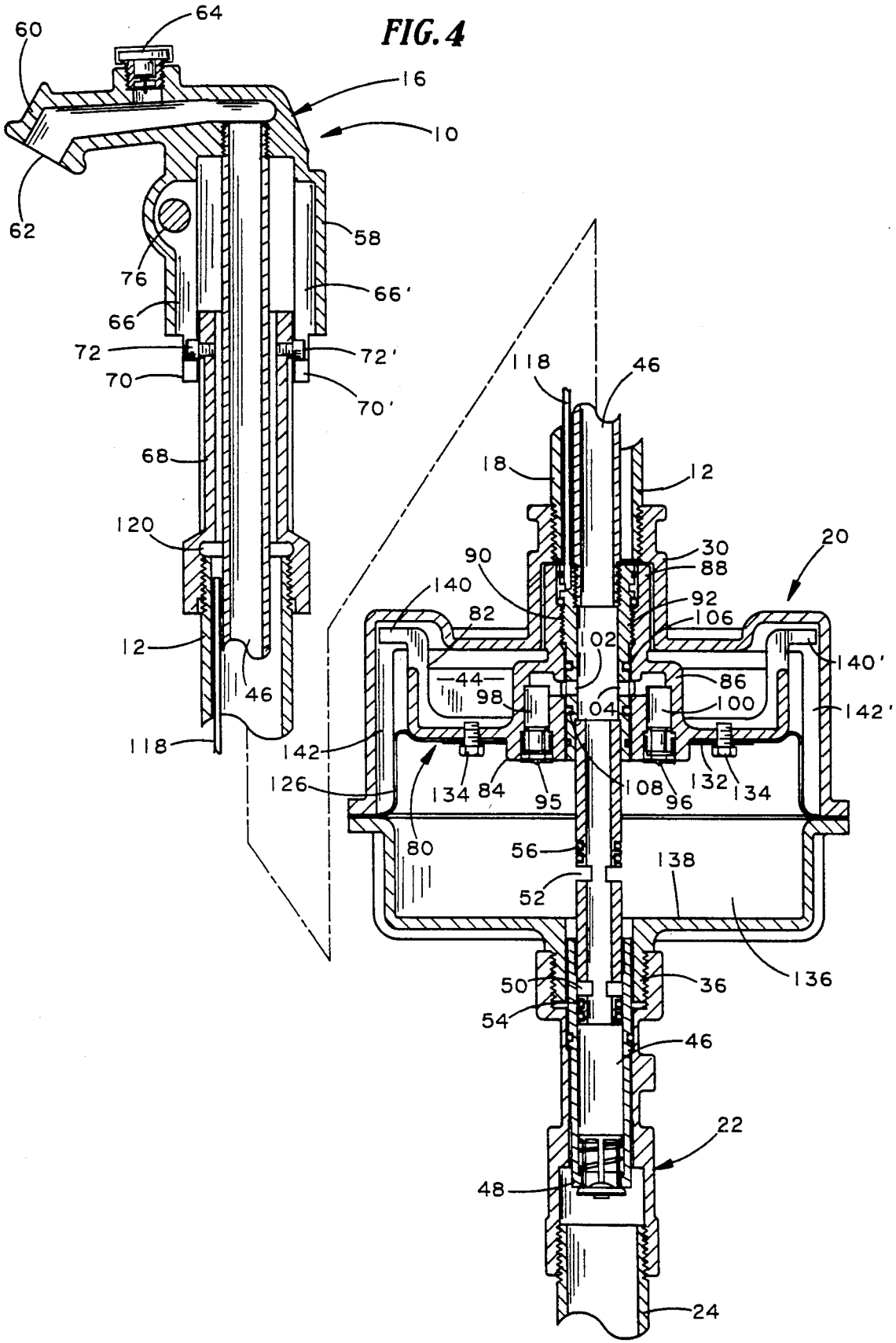
FIG. 4 is a view similar to FIG. 3 but showing the hydrant in closed or off position together with the uppermost position of the diaphragm assembly defining the expanded water storage area.
Figure 5:
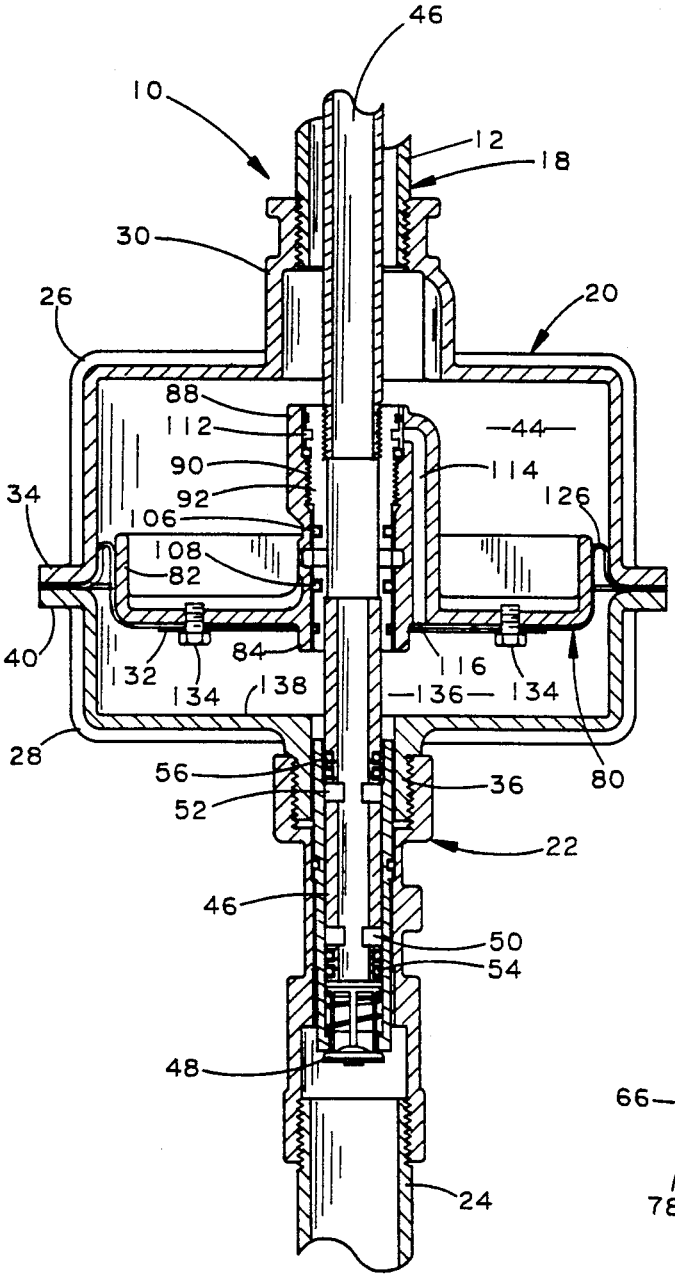
FIG. 5 is a cross sectional view taken on the line 5—5 of FIG. 1.

The water storage reservoir unit 20 has the complementary upper inverted cup-shaped member 26 and the lower cup-shaped member 28. Member 26 has the upstanding axial neck 30 that is internally threaded in its upper portion 32 (FIG. 2) to which the lower end 18 of casing 12 is threadably attached. The bottom of member 26 terminates in the peripheral flange 34. Member 28 has the depending axial externally threaded neck 36 and the through bore 38. The upper end of the valve body 22 is threadably attached to neck 36 and the lower end thereof is similarly attached to pipe 24 that is connected to a source of water supply under pressure (not shown) in a well known manner. The upper end of member 28 terminates in the peripheral flange 40 that is secured in juxtaposition to flange 34 by a plurality of spaced bolts and nuts 42 to form the internal chamber 44 of unit 20 (FIGS. 3-5).

Thus far described, there is provided a through passageway from pipe 24 through the valve body housing 22, through the reservoir unit 20 and casing 12 to the head section 16, and the operating parts for water flow control therethrough and water storage in unit 20 are described as follows.

An elongated water pipe 46, having an upper, intermediate and lower section as will appear, is disposed in casing 12 for reciprocation therein and extends from the head section 16 through unit 20 into the valve body housing 22 for engagement with the plunger check valve 48 at the bottom of said housing. The lower section of pipe 46 has the lower water port 50 and the upper water port 52 with a pair of 0-rings 54 below port 50 and a like pair 56 above port 52. The reciprocation of pipe 46 between closed position (FIG. 4) and open position (FIG. 3) is as follows.

Figure 6:
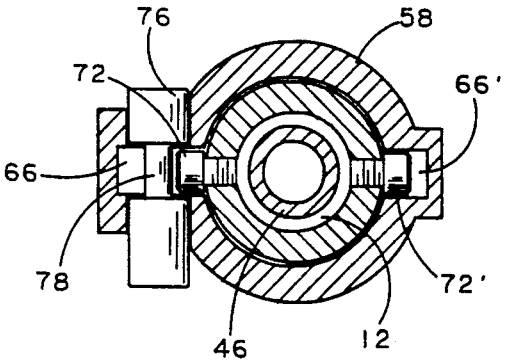
FIG. 6 is a cross sectional view taken on the line 6—6 of FIG. 3.

Head section 16 includes a hollow body portion 58 having an integral nozzle 60 with water passageway 62, an air check valve 64 for said passageway, and opposed vertical slots 66,66' on its interior walls. The upper end of pipe 46 is threadably attached to body portion 58 in communication with passageway 62 (FIGS. 3, 4). A head guide 68 is threadably secured to the upper end 14 of casing 12 to extend upwardly therefrom and head section 16 is journalled on said guide for vertical reciprocation. Near the bottom of body portion 58 are opposed openings 70,70' (FIG. 3) in communication with respective slots 66,66'. Set screws 72,72', insertable through openings 70,70', are threadably secured to the top of guide 68 in the opposed openings 74,74' therein and move vertically in slots 66,66' whereby pipe 46 can be raised or lowered between the positions seen in FIGS. 3,4. A pin 76 (FIG. 6) in body portion 58 has a reduced intermediate portion 78 and is movable transversely of slot 66 so that with portion 78 positioned as seen in FIG. 6, there is clearance for movement of set screw 72 for raising and lowering water pipe 46. With the larger diameter portion of pin 76 in registration with slot 66, such movement is prevented as seen in FIG. 3. No invention is claimed in the above head section means for reciprocating water pipe 46 and the same can be done by any suitable means such as handle as is well known.

Figure 9:
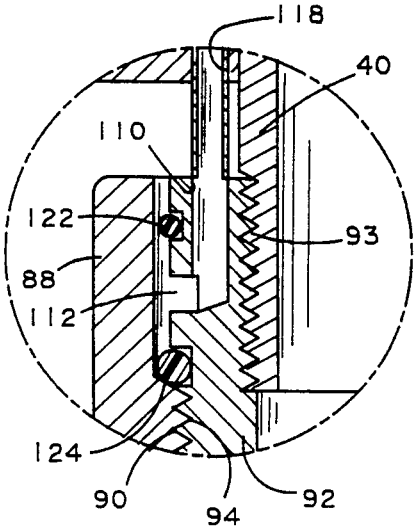
FIG. 9 is an enlargement of the area within the circle identified by the numeral 9 in FIG. 3.

Within chamber 44 of the reservoir unit 20 is a diaphragm assembly 80 removably secured to the water pipe 46 and vertically movable therewith when pipe 46 is moved to and from open and closed positions. Assembly 80 includes a cup-shaped diaphragm plate 82 provided with a short depending axial neck 84, an upstanding axial housing 86 and a reduced upstanding axial neck 88 integral with housing 86. Neck 88 is internally threaded 90 in its lower portion (FIG. 9). A pipe section 92, which I have called a diaphragm plate middle part, is in effect an intermediate section between the upper and lower sections of pipe 46, being internally threaded 93 at its upper end for attachment to pipe 46 and externally threaded 94 at its lower end for engagement with the threads 90 on neck 88 of diaphragm plate 82 as best seen in FIG. 9. In the bottom of neck 84 of plate 82 are check valves 95,96 at opposite sides of pipe 46 and in communication with flow passageways 98, 100 into housing 86 that in turn communicate with ports 102,104 in pipe 46. 0-rings 106 are on pipe 46 above ports 102,104 and like 0-rings 108 are below.

An air passageway 110 communicating with the top of neck 88 adjacent pipe 46 (FIGS. 7,9) passes around pipe 46 as at 112 and extends downwardly as at 114 (FIG. 5) to exit from port 116 (FIG. 8) in the bottom of neck 84. An air line 118 connects to passageway 110 and extends upwardly adjacent pipe 46 into the head guide 68 for communication with an air port 120 therein. O-rings 122,124 are provided in the upper portion of neck 88 as shown in FIG. 9.

Figure 7:
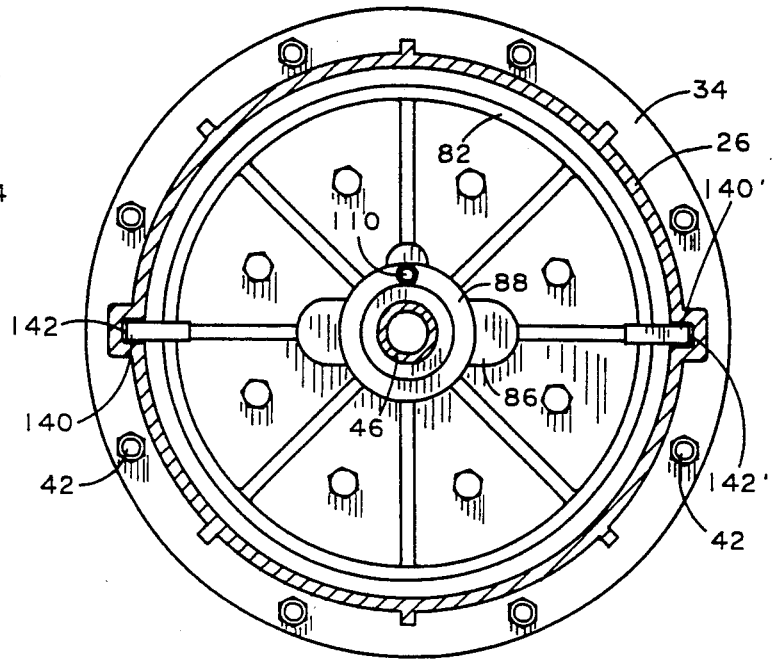
FIG. 7 is a cross sectional view taken on the line 7—7 of FIG. 3.
Figure 8:
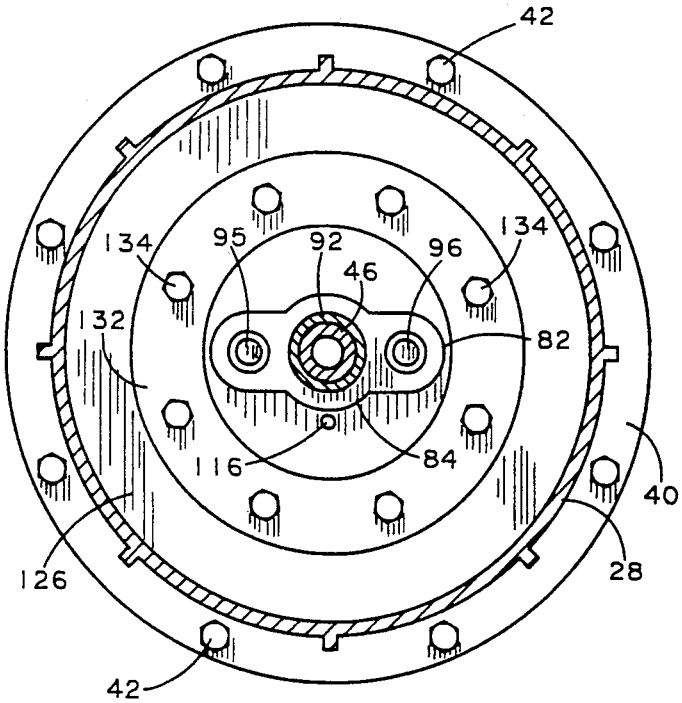
FIG. 8 is a cross sectional view taken on the line 8—8 of FIG. 3.

As a part of the diaphragm assembly 80 there is provided the inverted cup-shaped deformable diaphragm 126 having a peripheral flange 128 and an axial opening 130 corresponding to the diameter of depending neck 84 on the diaphragm plate 82. The axial opening 130 of diaphragm 126 is journalled around neck 84 on the bottom of plate 82 and secured thereto in water seal relationship by a flat copper ring 132 placed around neck 84 against diaphragm 126 that is secured to neck 84 by a plurality of concentrically spaced set screws 134. Flange 128 on diaphragm 126 is disposed between flange 34 on reservoir section 26 and flange 40 on section 28 thereof and secured thereto in watertight engagement by the bolts and nuts 42 previously described to provide the water storage area 136 within chamber 44 of unit 20 between diaphragm 126 and the inside bottom 138 of section 28. The air line formed by the several passageways 110,112,114,118 as described extends from port 116 within area 136 to port 120 in the head guide 68. Assembly 80, as described, will move upwardly and downwardly corresponding to the movement of pipe 46 to respectively increase and decrease the storage area 136 and in such movement, for reasons to appear, the diaphragm plate 82 is provided with oppositely opposed outwardly extending lips or bosses 140,140' that slide in respective opposed vertical channels 142,142' in the inner wall of section 26 of unit 20 as best seen in FIGS. 3,4,7.

OPERATION

The "on" position of hydrant 10 (FIG. 3) is obtained by pressing head section 16 downwardly which moves the water pipe 46 into engagement with the plunger check valve 48 to allow water to flow from pipe 24 through pipe 46 to nozzle 62 in a well known manner. In this position, the diaphragm assembly 80 is at its lowest point within chamber 44 and the water storage area 136 is at its smallest dimension. Also, the upper port 52 in pipe 46 has descended into the depending neck 36 of section 28 and by reason of 0-rings 56, area 136 is sealed off from any water system pressure. The "closed" position of hydrant 10 (FIG. 4) is obtained by raising head section 16 whereby pipe 46 moves out of contact with the plunger check valve 48 to close water flow from pipe 24 and in this movement, assembly 80 moves upwardly with pipe 46 to begin the enlargement of the water storage area 136. Such enlargement begins to occur prior to the movement of port 52 into area 136 and during this interval, to fill the void created, air enters area 136 through port 116. When port 52 enters area 136, water in pipe 46, no longer under pressure, flows down pipe 46 out of port 52 into such area 136 which has expanded to accommodate and store such residual water without danger of pollution.

When hydrant 10 is next moved to "on" position, assembly 80 is moved downwardly correspondingly and while port 52 remains within area 136, water will flow into port 52 into pipe 46 and when port 52 has descended into neck 36 of section 28 so as to be out of flow communication with area 136, substantially all of the remaining water in such area will flow through the check valves 95,96 through passageways 98,100 into pipe 46 for discharge out of nozzle 62 with the new flow from pipe 24.

To remove pipe 46 for servicing or repairs, such pipe is unscrewed from the diaphragm plate middle part 92 (FIG. 9). The threadable connection of part 92 to the neck portion 88 of the diaphragm plate 82 is designed to respond to less torque for loosing than that required to remove pipe 46 from part 92 so that as pipe 46 is unscrewed, the attachment of such pipe to part 92 holds and the attachment of part 92 to neck 88 of diaphragm plate 82 is released to permit pipe 46 to be released within. During this removal process, the bosses 140,140' within channels 142,142' in section 26 prevent rotation of assembly 80. Hydrant 10, thus described, is exceedingly effective for its intended purpose and by being built around the riser in direct association therewith, is more cost effective relative to the size and number of parts required as compared with other similar devices described above, Accordingly, in view of the foregoing, it is thought a full understanding of the construction and operation of this invention will be had and the advantages of the same will be appreciated.

I claim:

1. A yard hydrant, comprising:
- a head section including an integral nozzle with a water passageway therein,
- a water pipe,
- a valve means adapted for connection to a source of water supply under pressure,
- said water pipe operably connected at one end to said head section in communication with said water passageway and operably engageable at the other end with said valve means,
- means for reciprocating said water pipe,
- a cylindrical water reservoir unit disposed around said water pipe intermediate said head section and said valve means,
- a diaphragm assembly within said water reservoir unit providing a watertight expandable water storage area, and secured to said water pipe for reciprocation therewith,
- the downwardly movement of said water pipe into engagement with said valve means defining the "on" position for water flow through said yard hydrant, and the upwardly movement of said water pipe out of engagement with said valve means defining the "off" position of said water flow, with said water storage area in said "off" position to permit residual water in said water pipe to flow into said storage area, and a flow controlling valve means disposed in said disphragm assembly communicating with said water pipe and said water storage area to permit stored water to return to said water pipe in the "on" position for discharge out of said nozzle valve means in said diaphragm assembly.

2. A yard hydrant as defined in claim 1, including said water pipe being removably secured to said diaphragm assembly whereby said water pipe can be separated therefrom and removed from said yard hydrant.

3. A yard hydrant as defined in claim 2, including:
- said water pipe being attached to said diaphragm assembly by a threadable attachment, and
- means in said water reservoir unit for preventing rotation of said diaphragm assembly while said water pipe is being separated therefrom.

4. A yard hydrant as defined in claim 1 wherein said flow controlling valve means is a check valve.

5. A yard hydrant as defined in claim 1, including:
- said water reservoir unit comprising:
  - an upper inverted cup-shaped section and a lower cup-shaped section, each having a peripheral flange, and
  - fastening means to secure said flanges in juxtaposition, said diaphragm assembly comprising:
- a diaphragm plate within said water reservoir unit secured to said water pipe for reciprocation therewith, and
  - a deformable diaphragm secured to said diaphragm plate and extending peripherally between and secured to said flanges in watertight relationship to define said water storage area.

6. A yard hydrant as defined in claim 5, including said water pipe being removably secured to said diaphragm plate whereby said water pipe can be separated therefrom and removed from said yard hydrant.

7. A yard hydrant as defined in claim 6, including:
- said water pipe being threadably attached to said diaphragm plate, and
- means in said water reservoir unit for preventing rotation of said diaphragm plate while said water pipe is being separated therefrom.

8. A yard hydrant as defined in claim 1, including an air line open to the atmosphere at one end and extending through said diaphragm assembly into communication with said water storage area.

9. A yard hydrant as defined in claim 1, including means to seal off said water storage area from the water supply pressure.

10. A yard hydrant comprising:

a vertical casing having an upper end and a lower end, a head section, including an integral nozzle with a water passageway therein, mounted to said upper end, a cylindrical water reservoir unit, having a top end and a bottom, axially mounted at said top end to said lower end of said casing, a valve body housing, with valve means, adapted at one end for connection to a source of water supply under pressure, said bottom of said cylindrical water reservoir unit being axially mounted to the other end of said valve body housing, a water pipe operably attached to said head section in communication with said water passageway therein and extending through said casing and said water reservoir unit into said valve body housing for operable engagement with said valve means, means for reciprocating said water pipe, a diaphragm assembly within said water reservoir unit providing a watertight expandable water storage area, and secured to said water pipe for reciprocation therewith, a valve flow port in said water pipe adapted to move into and out of flow communication with said water storage area during the reciprocal movement of said pipe, a flow port in said water pipe in spaced above relationship to said valve flow port, when said valve flow port is movable into said valve housing to shut off flow to said storage area for water flow communication from said water storage area to said flow port, the downwardly movement of said water pipe into engagement with said valve means defining the "on" position of water flow through said yard hydrant, and the upwardly movement of said water pipe out of engagement with said valve means defining the "off" position of said water flow, with said yard hydrant in the "off" position, said valve flow port communicates with said water storage area and residual water in said water pipe flows therethrough into said water storage area, and with said yard hydrant in the "on" position, said valve flow port is out of flow communication with said water storage area and water therein flows through said second flow port into said water pipe for discharge through said nozzle when said valve flow port is movable into said valve housing to shut off flow to said storage area.

11. A yard hydrant as defined in claim 10, including said water pipe being removably secured to said diaphragm assembly whereby said water pipe can be separated therefrom and removed from said yard hydrant.

12. A yard hydrant as defined in claim 10, including means to seal off said water storage area from the water supply pressure.

13. A yard hydrant as defined in claim 10, including an air line open to the atmosphere at one end and extending through said diaphragm assembly into communication with said water storage area.

14. A yard hydrant as defined in claim 10 wherein the valve means in said diaphragm assembly for water flow communication from said water storage area to said flow port is a check valve.

15. A yard hydrant as defined in claim 10, including:

said water reservoir unit comprising:

an upper inverted cup-shaped section and a lower cup-shaped section, each having a peripheral flange, and fastening means to secure said flanges in juxtaposition, said diaphragm assembly comprising:

a diaphragm plate within said water reservoir unit secured to said water pipe for reciprocation therewith, and a deformable diaphragm secured to said diaphragm plate and extending peripherally between and secured to said flanges in watertight relationship to define said water storage area.

16. A yard hydrant as defined in claim 15, including said water pipe being removably secured to said diaphragm plate whereby said water pipe can be separated therefrom and removed from said yard hydrant.

17. A yard hydrant as defined in claim 16, including:

said water pipe being threadably attached to said diaphragm plate, and means in said water reservoir unit for preventing rotation of said diaphragm plate while said water pipe is being separated therefrom.

* * * * *